US007908714B2

(12) United States Patent
Breuer et al.

(10) Patent No.: US 7,908,714 B2
(45) Date of Patent: Mar. 22, 2011

(54) APPARATUS AT A SPINNING PREPARATION MACHINE FOR THE PURPOSE OF MONITORING

(75) Inventors: Achim Breuer, Aachen (DE); Christoph Färber, Korschenbroich (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 1045 days.

(21) Appl. No.: 11/527,445

(22) Filed: Sep. 27, 2006

(65) Prior Publication Data

US 2007/0089275 A1 Apr. 26, 2007

(30) Foreign Application Priority Data

Oct. 21, 2005 (DE) ..... 10 2005 050 904

(51) Int. Cl.
*D01G 31/00* (2006.01)

(52) U.S. Cl. ..... 19/0.25

(58) Field of Classification Search ..... 19/0.2, 19/0.23, 0.24, 0.25, 239, 240, 99, 106 R, 19/110, 112–114
See application file for complete search history.

(56) References Cited

U.S. PATENT DOCUMENTS

| | | | | |
|---|---|---|---|---|
| 4,163,927 | A * | 8/1979 | Grice, Jr. | 318/68 |
| 4,817,247 | A * | 4/1989 | Leifeld et al. | 19/105 |
| 5,010,624 | A * | 4/1991 | Stahlecker | 19/261 |
| 5,040,272 | A | 8/1991 | Fritzsche | |
| 5,774,943 | A * | 7/1998 | Clapp et al. | 19/240 |
| 5,873,230 | A * | 2/1999 | Wussmann et al. | 57/315 |
| 2007/0033917 | A1 | 2/2007 | Pferdmenges | |

FOREIGN PATENT DOCUMENTS

| | | | |
|---|---|---|---|
| DE | 199 23 420 | A1 | 11/2000 |
| DE | 102 51 574 | A1 | 5/2004 |
| DE | 103 31 734 | A1 | 2/2005 |
| EP | 0 384 297 | B1 | 8/1990 |
| EP | 0 627 508 | A1 | 12/1994 |
| EP | 0 801 158 | A1 | 10/1997 |
| EP | 1158078 | A3 | 11/2001 |
| GB | 2 368 351 | A | 5/2002 |
| GB | 2 430 942 | A | 4/2007 |

OTHER PUBLICATIONS

British Search Report dated Feb. 16, 2007, issued in GB 0620596.7.
German International Search Report dated Apr. 18, 2006, issued in DE 10 2005 050 904.5.

* cited by examiner

*Primary Examiner* — Tejash Patel
(74) *Attorney, Agent, or Firm* — Venable LLP; Robert Kinberg; Leigh D. Thelen

(57) ABSTRACT

In an apparatus at a spinning preparation machine, especially a flat card, roller card or the like, for the purpose of monitoring, a clothed, rapidly rotating roller lies opposite to at least one clothed and/or non-clothed component, and the spacing a between the components lying opposite to one another is changeable. To avoid contact between the components lying opposite to one another in a simple manner, in order to monitor the spacing, there is located opposite to the clothing of the roller, spaced therefrom, a sensor that is arranged to respond in the event of contact between clothing and sensor.

21 Claims, 3 Drawing Sheets

APPARATUS AT A SPINNING PREPARATION MACHINE FOR THE PURPOSE OF MONITORING

CROSS REFERENCE TO RELATED APPLICATION

This application claims priority from German Patent Application No. 10 2005 050 904.5 dated Oct. 21, 2005, the entire disclosure of which is incorporated herein by reference.

BACKGROUND OF THE INVENTION

The invention relates to an apparatus at a spinning preparation machine, especially at a flat card, roller card or the like, in which a clothed, rapidly rotating roller lies opposite to at least one clothed and/or non-clothed component and the spacing between the components lying opposite to one another is changeable.

In flat cards, crashes occur that are caused by incorrect settings or incorrect machine operation. The repair costs for such crashes are considerable. The result of even any slight contact between a stationary component and, for example, a carding cylinder, is destructive because, in the event of contact, the roller clothing strongly takes hold of the components because of its aggressive tooth setting and, when contact is identified, for example by an operator, the rollers run on for at least five minutes until they come to a standstill. During that time the damage becomes ever greater.

The effective spacing of the tips of a clothing from a machine element lying opposite to the clothing is called the carding nip. The last-mentioned element may also have a clothing but could, instead of that, be formed by a segment of a circuit having a conductive face. The carding nip determines the carding quality. The size (width) of the carding nip is an important machine parameter that shapes both the technology (fibre processing) and the running behaviour of the machine. The carding nip is set as narrow as possible (it is measured in tenths of a millimeter) without the risk of a "collision" of the working elements being incurred. In order to ensure uniform processing of the fibres, the nip needs to be as identical as possible over the whole of the working width of the machine.

The carding nip is affected especially by the machine settings on the one hand and by the condition of the clothing on the other hand. The most important carding nip of the revolving card top flat card is located in the main carding zone, that is to say between the cylinder and the revolving card top assembly. At least one clothing that limits the working spacing of the carding zone as a whole is in motion, usually both. In order to increase the production rate of the flat card, it is sought to select an operating rotational speed, or an operating speed of the moving parts, that is as high as the fibre processing technology allows. The working spacing changes in dependence on the operating conditions. The change occurs in the radial direction (starting from the rotational axis) of the cylinder.

During carding, increasingly large amounts of fibre material are processed per unit of time, which requires higher working component speeds and higher installed outputs. The increasing throughput of fibre material (production rate), even when the working surface area remains constant, results in increased generation of heat as a result of the mechanical work. At the same time, however, the technological carding result (sliver uniformity, degree of cleaning, nep reduction etc.) is constantly being improved, which requires a greater number of effective surfaces in carding engagement and narrower settings of those effective surfaces with respect to the cylinder (tambour). The proportion of synthetic fibres being processed, which—compared with cotton—generate more heat as a result of friction when in contact with the effective surfaces of the machine, is continually increasing. The working components of high-performance flat cards are nowadays totally enclosed on all sides in order to conform to the high safety standards, to prevent the emission of particles into the spinning room environment and to minimise the need for servicing of the machines. Grids or even open, material-guiding surfaces allowing exchange of air are a thing of the past. The said circumstances markedly increase the input of heat into the machine, while the discharge of heat by means of convection is markedly reduced. The resulting more intense heating of high-performance flat cards leads to greater thermoelastic deformation which, on account of the non-uniform distribution of the temperature field, affects the set spacings of the effective surfaces: the gaps between cylinder and card top, doffer, fixed card flats and take-off stations with blades are reduced. In an extreme case, the set gap between the effective surfaces can be completely consumed by thermal expansion, so that components moving relative to one another collide, resulting in considerable damage to the affected high-performance flat card. Accordingly, particularly the generation of heat in the working region of the flat card can lead to different degrees of thermal expansion when the temperature differences between the components are too great.

In order to reduce or avoid the risk of collisions, the carding nip between clothings lying opposite to one another is in practice set relatively wide, that is to say a certain safety spacing exists, but a large carding nip results in undesired nep formation in the card sliver. On the other hand, an optimum, especially narrow, dimension, by means of which the nep occurrence in the card sliver is appreciably reduced, is desirable.

It is an aim of the invention to provide an apparatus of the type described at the outset that avoids or mitigates the mentioned disadvantages and, especially, when opposite-lying components draw near to one another, avoids contact between those components in a simple manner.

SUMMARY OF THE INVENTION

The invention provides an apparatus at a spinning preparation machine for the purpose of monitoring the spacing between a clothed, rapidly rotating roller and at least one clothed and/or non-clothed component opposed to said roller, the spacing between the roller and said component(s) lying opposite thereto being changeable, comprising a sensor which is arranged to give rise to a response in the event of contact between the roller and a said component.

In an especially preferred embodiment there is, arranged opposite to the clothing of the roller, at a second spacing, a sensor which is a part of an electrical circuit, wherein contact between the clothing and the sensor causes interruption of the circuit.

According to the invention, the sensor is set closer to the roller than is the component lying opposite to the roller. In the event of contact with the rapidly rotating roller, the sensor is destroyed. When that happens, electrical transmission is cut and consequently electric current, for example to a control system, display or alarm device, switching device or the like, is interrupted. The sensor is constantly energised. If, for example, a cable, which runs parallel in the sensor to the roller, is destroyed by contact with a clothing, the circuit is interrupted and a signal is delivered. For the crash sensor, that constitutes a destructive measurement.

Advantageously, starting from the roller, the second spacing to the sensor is smaller than the spacing to the component. Advantageously, the sensor is immobile. Advantageously, the sensor is an electrically conductive component of the electric circuit. Advantageously, two lines are connected to the electrically conducting sensor. Advantageously, at least one electrically conductive element, for example wire, is integrated into the sensor. Advantageously, the sensor consists of plastics or the like in which an electrical conductor is integrated. Advantageously, the current line is passed through the sensor body. Advantageously, an electrically conducting wire (current line) is embedded into the sensor body. Advantageously, the sensor body has a conductive coating, a conductive cover or the like. Advantageously, the sensor is arranged in the vicinity of the roller. Advantageously, the sensor generates an electric signal change directly from any contact between the component and the roller. Advantageously, the signal change is fed to a control system. Advantageously, the sensor is mounted at a carding machine, for example a flat card. The sensor may be fastened to a mounted component. The sensor may be fastened to a working element. The sensor may be fastened to an immobile side panel. The sensor may be fastened to an extension bend or flexible bend of a cylinder. Advantageously, the sensor is fastened to the side of a mounted component that faces a roller. Advantageously, an electrically conducting cable is guided into a body, for example a cylindrical body or the like, parallel to the surface. Advantageously, the cable lies directly below the body surface. Advantageously, in the event of contact of the sensor with a roller clothing, the cable is destroyed at the surface by the clothing and thus the electric current is interrupted. Advantageously, the sensor is fastened into a mounted component at the roller side in such a manner that the cable parallel to the sensor surface is aligned close to the roller and parallel thereto. Advantageously, the sensor is so fastened in the mounted component that the spacing between roller and sensor is smaller than or equal to the spacing between roller and mounted component. Advantageously, there is a plurality of sensors attached to a mounted component. Advantageously, each group of mounted components is equipped at least with one or more sensors. Advantageously, each mounted component, which is set as close as possible to the roller, is equipped with a sensor. Advantageously, the signals of the sensors are evaluated by the control system. Advantageously, the sensor is connected to an alarm device. Advantageously, the sensor is connected to a display device. Advantageously, the sensor is connected to a cut-off device for the carding machine.

The invention also provides an apparatus at a spinning preparation machine, especially a flat card, roller card or the like, for the purpose of monitoring, in which a clothed, rapidly rotating roller lies opposite to at least one clothed and/or non-clothed component and the spacing between the components lying opposite to one another is changeable, in which, in order to monitor the spacing between the components lying opposite to one another, there is arranged opposite to the clothing of the roller, at a spacing, a sensor which is an integral component of an electric current line, wherein contact between clothing and sensor or current line interrupts the circuit.

Moreover, the invention provides an apparatus at a spinning preparation machine, especially a flat card, roller card or the like, for the purpose of monitoring, in which a clothed, rapidly rotating roller lies opposite to at least one clothed and/or non-clothed component and the spacing between the components lying opposite to one another is changeable, in which, in order to monitor the spacing between the components lying opposite to one another there is provided a sensor which, in the event of contact between the components lying opposite to one another, delivers an electric signal.

Advantageously, a piezo-ceramic sensor is used. Advantageously, the piezo-ceramic sensor is a sensor for structure-born noise. Advantageously, the piezo-ceramic sensor is fastened to a clothed carding element. Advantageously, the piezo-ceramic sensor is fastened to a flexible bend. Advantageously, the piezo-ceramic sensor is fastened to an extension bend.

DETAILED DESCRIPTION OF CERTAIN PREFERRED EMBODIMENTS

Figure 1:
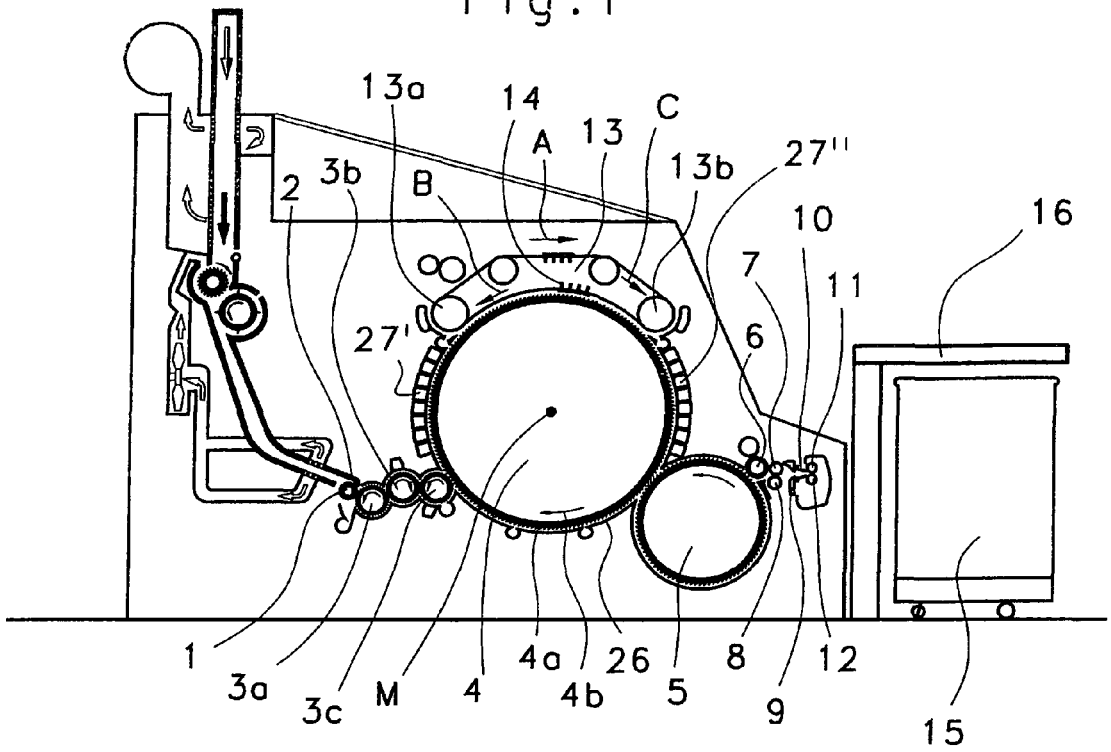
FIG. 1 is a diagrammatic side view, in section, of a flat card in which there may be included apparatus according to the invention.

FIG. 1 shows a flat card, for example a TC 03 (Trademark) flat card made by Trützschler GmbH & Co. KG of Mönchengladbach, Germany, having a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and flats 14, can 15 and can coiler 16. The directions of rotation of the rollers are indicated by curved arrows. Reference letter M denotes the centre (axis) of the cylinder 4. Reference numeral 4*a* denotes the clothing and reference numeral 4*b* the direction of rotation of the cylinder 4. Reference letter B denotes the direction of rotation of the revolving card top 13 in the carding position and reference letter C denotes the return transport direction of the flats 14; reference numerals 27', 27" denote fixed carding elements and reference numeral 26 denotes a cover underneath the cylinder 4. The arrow A indicates the working direction.

Figure 2:
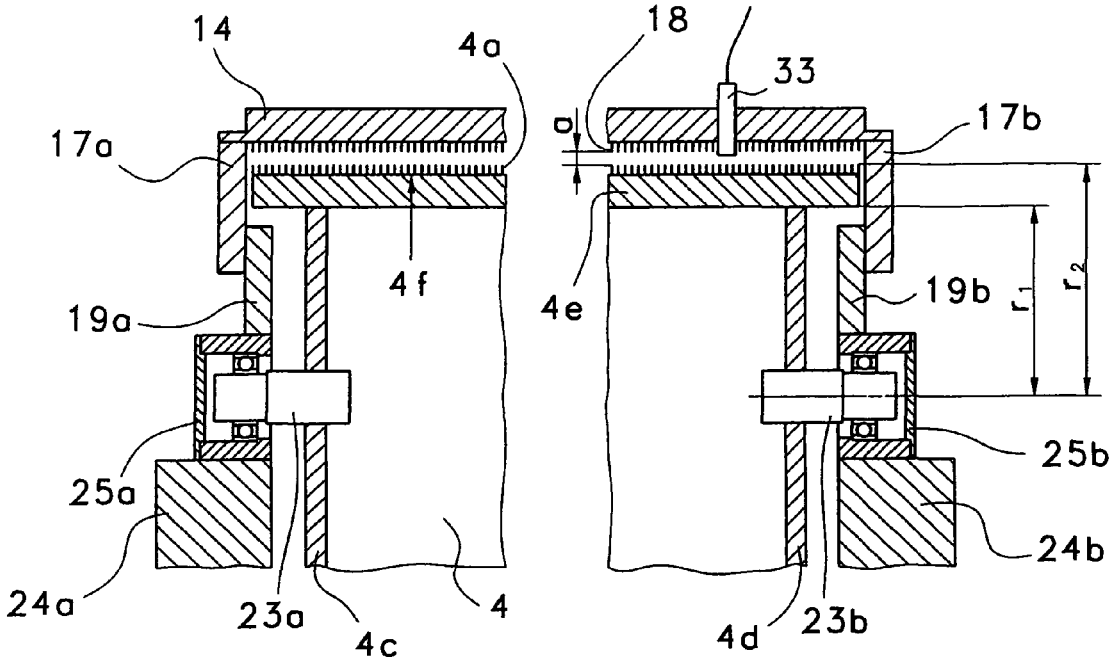
FIG. 2 is a partial view in section through the flat card according to FIG. 1 having an apparatus according to the invention.

FIG. 2 shows a portion of the cylinder 4 with a cylindrical surface 4*f* of the casing 4*e* and with cylinder ends 4*c*, 4*d* (radial support elements). The surface 4*f* is provided with a clothing 4*a* which, in this example, is provided in the form of wire with saw teeth. The saw-tooth wire is mounted on the cylinder 4, that is to say it is wound between side flanges (not shown) in closely juxtaposed windings to form a cylindrical working surface equipped with tips. Fibres are to be processed as uniformly as possible on the working surface (clothing). The carding is accomplished between the opposite-lying clothings 18 and 4*a*. It is appreciably affected by the position of one clothing in relation to the other and by the clothing spacing a between the tips of the teeth of the two clothings 18 and 4*a*. The working width of the cylinder 4 forms the basis for all other working elements of the flat card, especially for the revolving card top 13 or fixed card flats 27', 27" (FIG. 1), which, together with the cylinder 4, card the fibres uniformly over the whole of the working width. In order to be able to achieve uniform carding over the whole of the working width, the settings of the working elements (including additional elements) need to be maintained over that working width. The cylinder 4 itself may, however, become deformed as a result of the clothing wire's being drawn on, as a result of centrifugal force or as a result of heating caused by the carding process. The shaft journals 23*a*, 23*b* of the cylinder 4 are mounted in bearings 25*a*, 25*b*, which are mounted on the immobile machine frame 24*a*, 24*b*. The diameter, for example 1250 mm, of the cylindrical surface 4*f*, that is to say twice the radius $r_1$, is an important dimension of the machine. The side panels 19*a*, 19*b* are fastened onto the two machine frames 24*a* and 24*b*, respectively. Fastened to the side panels 19*a*, 19*b* are the flexible bends 17*a* and 17*b*, respectively. The circumferential speed of the cylinder 4 is, for example, 35 m/sec. Reference numeral 33 denotes a sensor which is associated with a revolving card flat 14, the spacing b from the cylinder clothing 4*a* to the end faces 33*a* of the sensor 33 being smaller than the spacing to the card top clothing 18 (see FIG. 3).

Figure 3:
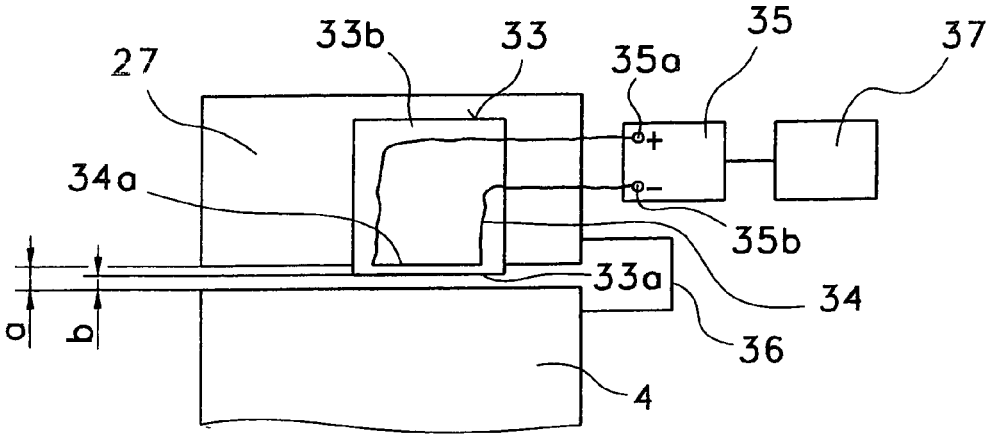
FIG. 3 shows an embodiment in which the sensor is an integral component of a current line.

In the embodiment of FIG. 3, the sensor 33 consists of a basic body 33*b*, for example of plastics material or the like, in which there is integrated an electrical conductor 34, for example a metal wire, a cable or the like. In the region denoted by reference numeral 34*a*, the wire 34 is arranged parallel to the end face 33*a* and to the clothing 4*a* (see FIG. 2). The wire 34 is permanently connected to a voltage supply 35. There is normal earth contact between the metal component 27 and the metal roller 4 by way of the line 36. Current flows continuously between the contacts 35*a* and 35*b*. If, during operation, the cable 34, which runs parallel (see 34*a*) in the sensor 33 to the roller 4, is destroyed by contact with the high-speed clothing 4*a*, the circuit is interrupted and a signal is delivered in a display device 37 and/or a switching procedure is triggered in a switching device (not shown), for example a switching-off device.

Figure 4:
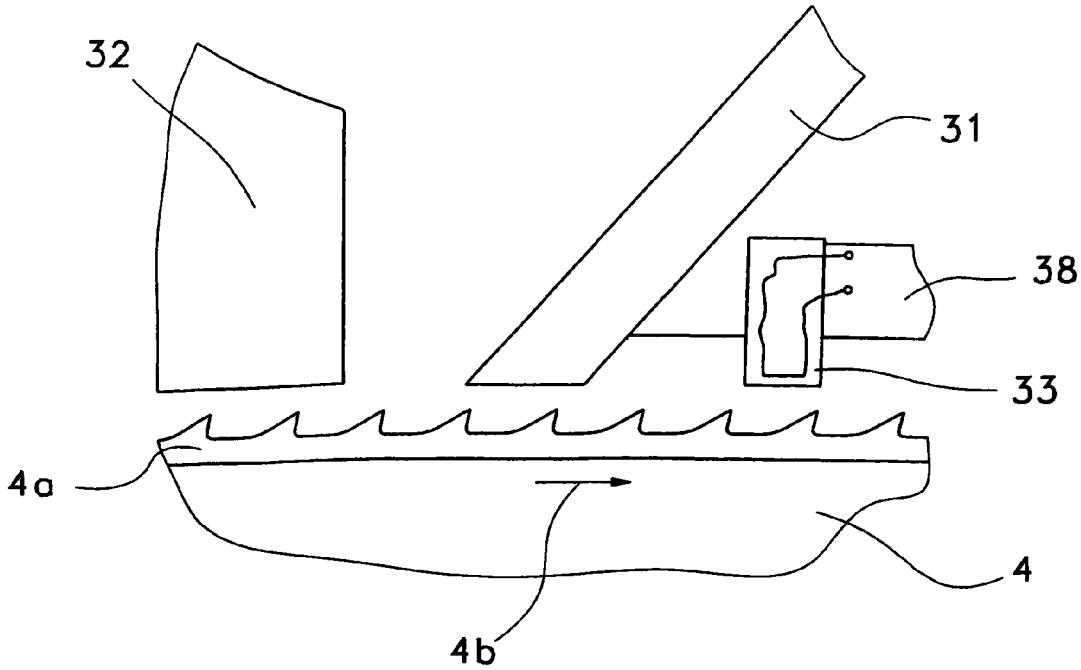
FIG. 4 shows an embodiment with a sensor at a holding element for a separator blade.

In the embodiment of FIG. 4, the sensor 33 is mounted at a holding element 38 (blade carrying rail) for a separator blade 31, that is, it is mounted at a non-clothed machine element. Reference numeral 32 denotes an immobile retainer frame.

The sensors 33 deliver an electric signal in the event of contact between the sensor 33 and a high-speed roller 4, for example the cylinder clothing 4*a*, that is, in the event of contact of the sensor 33 with a component. The purpose of that is to ascertain undesired contact between a component and a high-speed roller.

Figure 5:
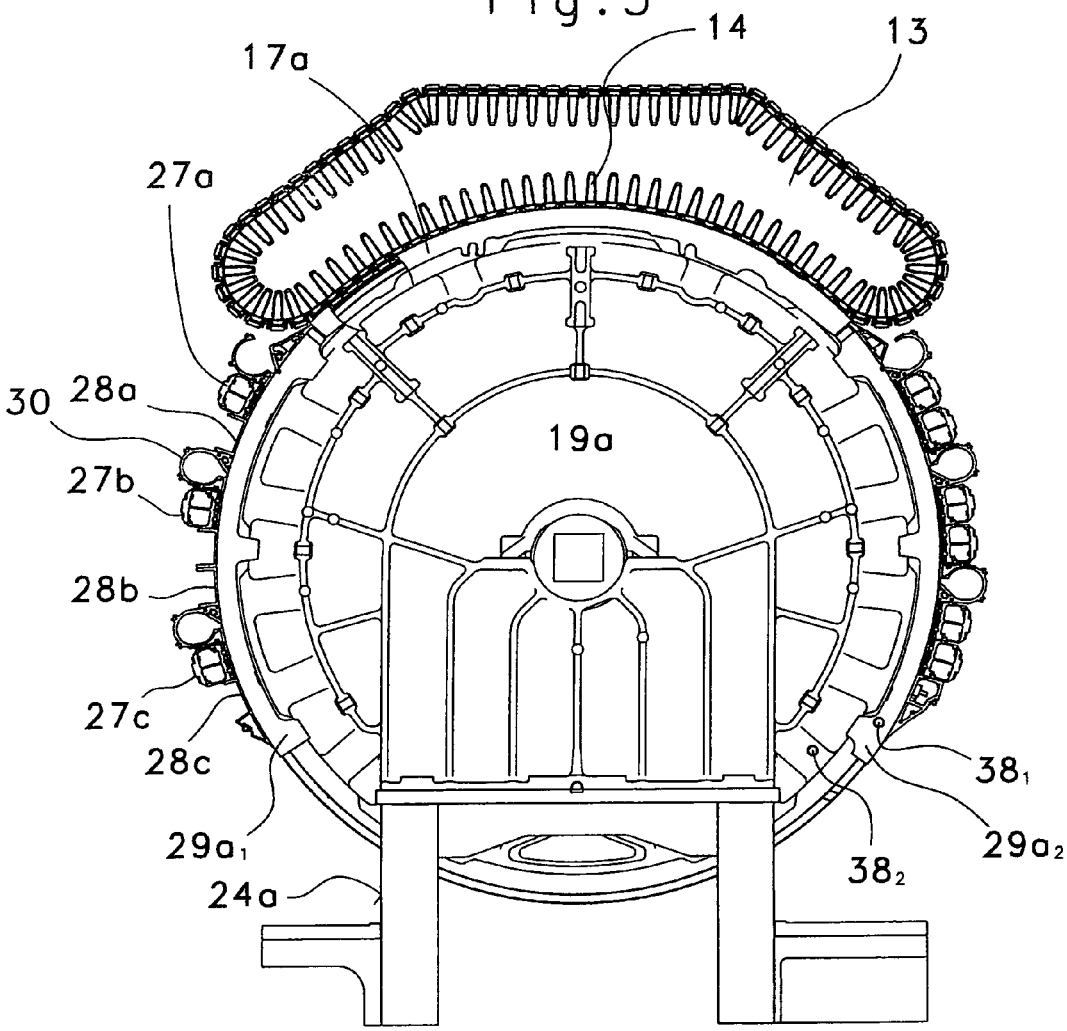
FIG. 5 is a side view of a part of a flat card with an immobile side panel, showing a portion of the machine frame and of the revolving card top of the flat card with a sensor both at an extension bend and at a side panel

In the embodiment of FIG. 5, between lickers-in 3 and card top guide roller 13*a* there are three immobile fixed carding elements 27*a*, 27*b* 27*c* and non-clothed cylinder casing elements 28*a*, 28*b*, 28*c*. The fixed carding elements 27 have a clothing that lies opposite to the cylinder clothing 4*a*. The fixed carding elements 27*a* to 27*c* are attached by way of screws and the cover elements 28*a* to 28*c* are attached by way of screws (not shown) to an extension bend 29*a* to 29*b* (in FIG. 5, only the extension bends 29*a*, $\mathbf{29}a_2$ on one side of the flat card are shown), which in turn is fastened by way of screws onto the flat card panel 19*a* and 19*b* (in FIG. 5, only 19*a* is shown) on each side of the flat card. The flexible bends 17*a*, 17*b* (in FIG. 5 only 17*a* is shown) are fastened by way of screws to the side panels 19*a* and 19*b*, respectively. Reference numeral 24*a* denotes the machine frame.

A sensor $\mathbf{38}_1$, is mounted at the immobile extension bend $\mathbf{29}a_2$ and a sensor $\mathbf{38}_2$ is mounted at the immobile side panel 19*a*. The sensors $\mathbf{38}_1$, and $\mathbf{38}_2$, for example piezo-ceramic sensors, register minimal component movements by measuring structure-borne noise.

Figure 6:
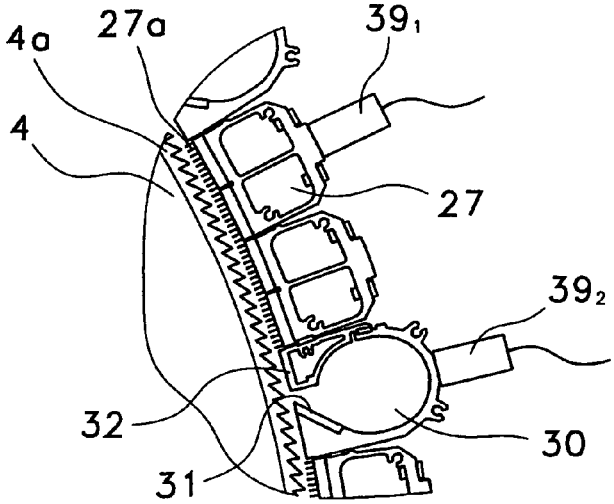
FIG. 6 shows a sensor at an exhaust hood of a flat card.

FIG. 6 shows an embodiment in which a sensor $\mathbf{39}_1$ is mounted at the fixed carding element 27 and a sensor $\mathbf{39}_2$ is mounted at the suction hood 30. The sensors $\mathbf{39}_1$, $\mathbf{39}_2$, for example acceleration sensors, register minimal component movements by measuring acceleration.

Sensors $\mathbf{38}_1$, $\mathbf{38}_2$ and $\mathbf{39}_1$, $\mathbf{39}_2$ deliver an electronic signal in the event of contact between a component of the flat card, for example fixed carding clothing $\mathbf{27}a_1$, and a roller 4, for example cylinder clothing 4*a*, that is, in the event of contact between two components lying opposite to one another at a spacing a. The aim in that arrangement is to prevent or to avoid undesirable contact between a component and a high-speed roller.

Although the foregoing invention has been described in detail by way of illustration and example for purposes of understanding, it will be obvious that changes and modifications may be practised within the scope of the appended claims.

The invention claimed is:

1. An apparatus at a spinning preparation machine for the purpose of monitoring the spacing between a rapidly rotating roller covered in roller clothing, and at least one clothed and/or non-clothed component opposed to said roller, the spacing between the roller and said at least one component lying opposite thereto being changeable, the apparatus further comprising, opposite the roller clothing, a sensor which is incorporated in an electrical circuit, the sensor being so arranged that contact between the roller clothing and the sensor breaks the sensor, thereby interrupting the circuit.

2. An apparatus at a spinning preparation machine for the purpose of monitoring the spacing between a clothed, rapidly rotating roller and at least one clothed and/or non-clothed component opposed to said roller, the spacing between the roller and said at least one component lying opposite thereto being changeable, the apparatus further comprising, opposite the roller clothing, a sensor which is incorporated in an electrical circuit, the sensor being so arranged that contact between the roller clothing and the sensor causes interruption of the circuit, wherein a second spacing between the roller and the sensor is smaller than the spacing between the roller and the component.

3. An apparatus according to claim 1, in which the sensor is immobile.

4. An apparatus according to claim 1, in which the sensor is an electrically conductive component of the electric circuit.

5. An apparatus according to claim 1, in which two lines are connected to the electrically conducting component.

6. An apparatus according to claim 1, in which the sensor comprises at least one electrically conductive element integrated into a sensor body.

7. An apparatus according to claim 6, in which the sensor has a plastics sensor body in which an electrical conductor is integrated.

8. An apparatus according to claim 6, in which the sensor body has a conductive coating or cover.

9. An apparatus according to claim 1, in which the sensor consists of an electrically conducting line that forms a portion of the electrical circuit.

10. An apparatus according to claim 1, in which the sensor is mounted at a carding machine.

11. An apparatus according to claim 1, in which the sensor is fastened to a working element.

12. An apparatus according to claim 1, in which the sensor is attached to an immobile side panel, or an extension bend or flexible bend of a carding machine.

13. An apparatus according to claim 1, in which an electrically conducting cable is guided into a body parallel to the surface of the body.

14. An apparatus at a spinning preparation machine for the purpose of monitoring the spacing between a rapidly rotating roller covered in roller clothing, and at least one clothed and/or non-clothed component opposed to said roller, the spacing between the roller and said at least one component lying opposite thereto being changeable, the apparatus further comprising, opposite the roller clothing, a sensor which is incorporated in an electrical circuit, the sensor being so arranged that contact between the roller clothing and the sensor breaks the sensor, thereby interrupting the circuit, and an electrically conducting cable that is guided into a body parallel to the surface of the body, wherein, in the event of contact of the sensor with a roller clothing, the electrically conducting cable is destroyed at the surface of the body by the clothing and thus the electric current is interrupted.

15. An apparatus according to claim 13, in which the sensor is fastened into a mounted component at the side of the component facing the roller in such a manner that the cable parallel to the sensor surface is aligned close to the roller and parallel thereto.

16. An apparatus according to claim 15, in which there is a plurality of sensors attached to a mounted component or to a plurality of mounted components.

17. An apparatus according to claim 15, in which there is a plurality of groups of mounted components, each group being equipped at least with one or more sensors.

18. An apparatus according to claim 1, in which the or each sensor is connected to an alarm device, to a display device, or to a cut-off device for the flat card.

19. An apparatus at a spinning preparation machine for the purpose of monitoring the spacing between a clothed rapidly rotating roller and at least one fixed carding element opposed to said roller, the spacing between the roller and said fixed carding element being changeable, the apparatus comprising a noise or vibration sensor coupled to the fixed carding element, wherein the noise or vibration sensor detects noise or vibration in the event of contact between the roller and the fixed carding element, and delivers an electrical signal.

20. An apparatus according to clam 19, in which the noise or vibration sensor comprises a piezo-ceramic sensor.

21. An apparatus according to claim 20, in which the piezo-ceramic sensor is attached to the fixed carding element, a fixed side panel, a flexible bend, or an extension bend.

* * * * *